US009212533B2

(12) United States Patent
Lembcke

(10) Patent No.: US 9,212,533 B2
(45) Date of Patent: Dec. 15, 2015

(54) CABLE BY-PASS FOR SPOOLED CABLES

(71) Applicant: Weatherford/Lamb, Inc., Houston, TX (US)

(72) Inventor: Jeffrey J. Lembcke, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 14/212,262

(22) Filed: Mar. 14, 2014

(65) Prior Publication Data

US 2014/0262352 A1 Sep. 18, 2014

Related U.S. Application Data

(60) Provisional application No. 61/783,347, filed on Mar. 14, 2013.

(51) Int. Cl.
*E21B 33/12* (2006.01)
*E21B 17/10* (2006.01)

(52) U.S. Cl.
CPC ..... *E21B 33/1208* (2013.01); *E21B 17/1042* (2013.01)

(58) Field of Classification Search
CPC ..... E21B 17/10; E21B 23/12
See application file for complete search history.

(56) References Cited

U.S. PATENT DOCUMENTS

| | | | | |
|---|---|---|---|---|
| 6,173,788 | B1 | 1/2001 | Lembcke | |
| 2004/0062497 | A1* | 4/2004 | Plemmons et al. | 385/109 |
| 2009/0277652 | A1* | 11/2009 | Nutley et al. | 166/387 |
| 2010/0230094 | A1 | 9/2010 | Foster | |
| 2011/0056706 | A1 | 3/2011 | Brooks | |
| 2012/0012342 | A1* | 1/2012 | Wilkin et al. | 166/387 |

OTHER PUBLICATIONS

International Search Report and Written Opinion received in corresponding PCT Application No. PCT/US2014/028249, dated Sep. 26, 2014, 11 pages.

* cited by examiner

*Primary Examiner* — William P Neuder
(74) *Attorney, Agent, or Firm* — Blank Rome, LLP

(57) ABSTRACT

A downhole tool with a swellable mantle is configured for insertion of a cable into a longitudinal slit in the mantle. An arcuate groove is formed in an outer surface of the mantle corresponding to a displacement caused by the inserted cable, so that the displacement is counteracted and the outer surface of the mantle remains smooth.

8 Claims, 3 Drawing Sheets

CABLE BY-PASS FOR SPOOLED CABLES

TECHNICAL FIELD

The present invention relates to the field of downhole tools, and in particular to a technique for feeding a spooled cable into a groove in a swellable mantle on a downhole tool.

BACKGROUND ART

The downhole industry has a need to monitor pressure in every zone of various multi-zone frac completions used in the shale plays around the world. There is a need to be able to feed a fiber optic cable into a groove in the swellable material of a swellable packer. The conventional technique for feeding the cable is to form a narrow groove in the swellable material that leads to a void space or chamber. The fiber optic cable is pushed into the groove until it lands in the void space. The void space avoids causing an outward extension of the swellable material caused by the fiber optic cable having a diameter larger than the width of the groove. Other conventional techniques form a groove at least as large as the diameter of the fiber optic cable. The cable is inserted, and filler material is inserted into the groove.

SUMMARY OF INVENTION

A portion of the outer surface of a mantle of swellable material around a downhole tool is removed. A narrow groove, narrower than the diameter of a fiber optic cable, is cut into the swellable material. When the fiber optic cable is pushed into the groove, the swellable material is pushed outwardly at the point of the removed outer surface, resulting in a smooth outer surface.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Figure 1:
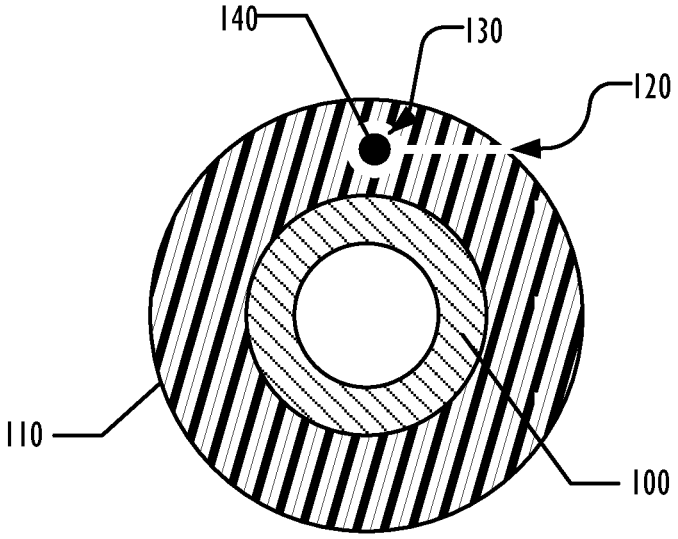
FIG. 1 (PRIOR ART)
FIG. 1 is a cross-sectional drawing of a swellable mantle with a groove and void space according to the prior art.

FIG. 1 is a cross-sectional diagram of a simple swellable device made of a mandrel 100 surrounded by a swellable mantle 110 according to the prior art. A narrow longitudinal slit 120 has been cut into the swellable mantle 110, and a void space 130 formed at the end of the slit. The cable 140 has been pushed through the slit 120 into the void space 130. Because the void space 130 has a larger diameter than the diameter of the cable 140, there is no bump or outward extension of the swellable mantle caused by the insertion of the cable 140.

Figure 2:
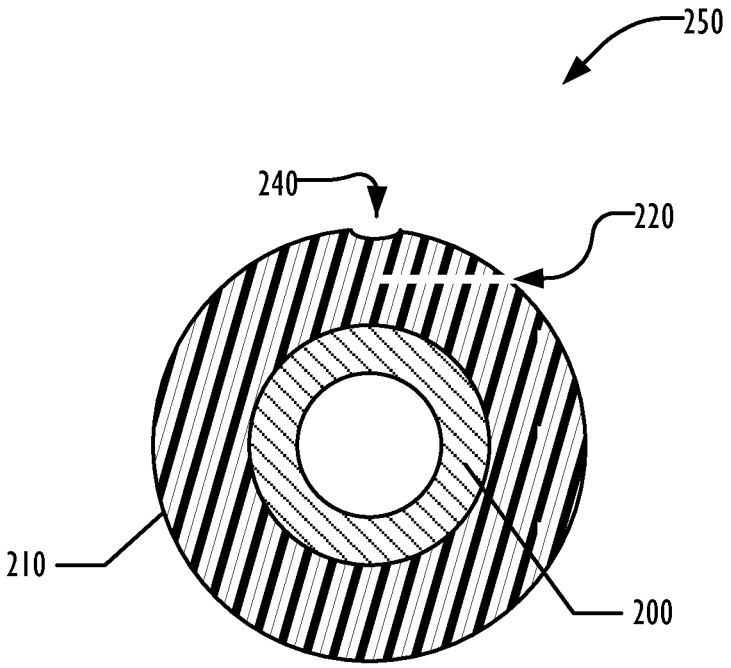
FIG. 2 is a cross-sectional drawing of a swellable mantle with a groove and outer surface indentation prior to insertion of a cable into the groove according to one embodiment.

FIG. 2 is a cross-sectional diagram of a simple downhole tool 250 made of a mandrel 200 surrounded by a swellable mantle 210 according to one embodiment. A narrow longitudinal slit 220 has been cut into the swellable mantle 210, but unlike the prior art example of FIG. 1, there is no void space at the end of the slit. However, an indentation 240 has been formed along the outer surface of the swellable mantle 210, corresponding to the innermost end of the slit 220. The slit 220 has a width narrower than the cable 140 that is to be inserted into the slit 220. Although described here simply as a mandrel, the mantle 210 may be formed about any type of inner device usable in a downhole tool. The slit may be cut at any desired angle, including radially, and may extend to any desired depth.

The indentation or groove 240 may be formed by milling or any other desired technique for removing an arcuate portion of the outer surface of the mantle 210. Preferably the indentation 240 is formed prior to the insertion of the cable 140. The size of the groove can be calculated based on the diameter of the cable 140, the width of the slit 220, and the compressibility of the swellable material forming the swellable mantle 210. Alternately, simply inserting the cable 140 into an unindented swellable mantle 210, milling or otherwise cutting away the bump formed by the insertion of the cable 140, then removing the cable 140 and measuring the resulting indentation can be used to determine the amount of material that needs to be removed from the outer surface of the swellable mantle 210 for a given size mantle, slit, and cable.

Figure 3:
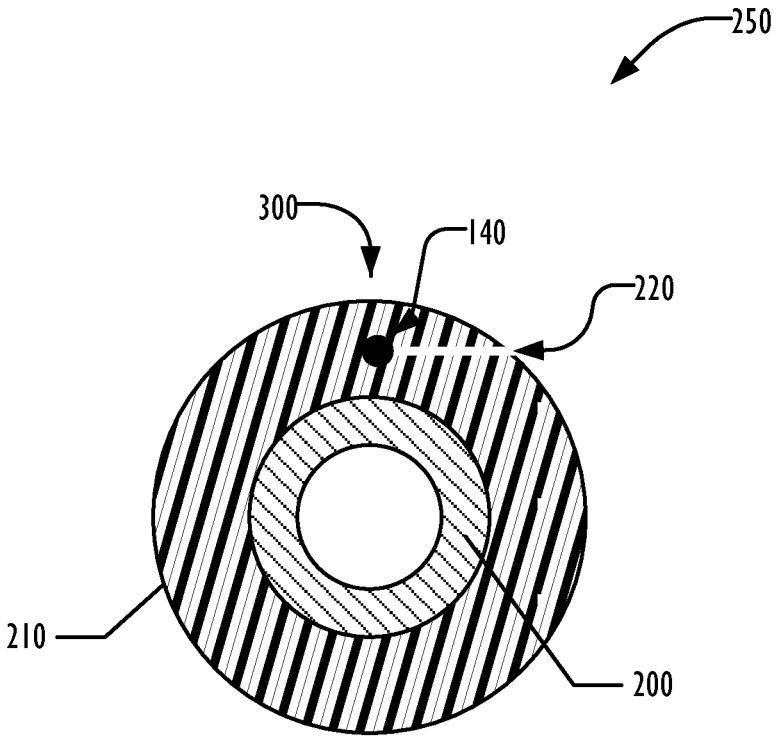
FIG. 3 is a cross-sectional drawing of the swellable mantle of FIG. 2 after insertion of the cable into the groove.

FIG. 3 is a view of the downhole tool 250 of FIG. 2 after the insertion of the cable 140. As illustrated by the drawing, the outward extension of the swellable mantle 210 caused by the cable 140 has countered the indentation illustrated in FIG. 2, resulting in a smooth outer surface area 300 as desired.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled.

What is claimed is:

1. A downhole tool, comprising:

a mandrel;

a swellable mantle formed about the mandrel;

a longitudinal slit cut into the swellable mantle inward from an outer surface of the swellable mantle; and a longitudinal indentation formed on an outer surface of the swellable mantle, positioned to correspond to an innermost end of the longitudinal slit and sized to counter a displacement that would be formed by insertion of a cable into the longitudinal slit, wherein a size of the longitudinal indentation is determined by one or more of:

measuring a displacement of the swellable mantle after insertion of a cable into the longitudinal slit; and calculating the size based on a diameter of the cable to be inserted, a width of the slit, and a compressibility of the swellable mantle.

2. The downhole tool of claim 1, further comprising a cable inserted into the longitudinal slit to the innermost end of the longitudinal slit, wherein a portion of swellable mantle along the longitudinal indentation is displaced by the inserted cable, eliminating the longitudinal indentation in the outer surface of the swellable mantle.

3. The downhole tool of claim 1, wherein the longitudinal indentation is milled into the outer surface of the swellable mantle.

4. A method of forming a downhole tool, comprising:

disposing a mantle about a mandrel, wherein the mantle is formed of a swellable material;

cutting a slit inward from an outer surface of the mantle, longitudinally along the mantle;

inserting a cable into the slit, disposing the cable at an innermost end of the slit; and forming an arcuate groove on an outer surface of the mantle longitudinally along the mantle, wherein the arcuate groove is sized corresponding to a displacement of the swellable material caused by the cable.

5. The method of claim 4, wherein forming an arcuate groove comprises:

milling the arcuate groove into an outer surface of the mantle.

6. The method of claim 4, wherein forming an arcuate groove comprises:

measuring a displacement of the mantle after insertion of the cable into the slit;

removing the cable; and forming an arcuate groove sized to counter the measured displacement.

7. The method of claim 4, wherein forming an arcuate groove comprises:

calculating a size of the arcuate groove based at least in part on a diameter of the cable, a width of the slit, and a compressibility of the mantle.

8. A swellable mantle for a downhole tool, comprising:

a mantle, configured for disposal about a downhole tool, the mantle composed of a swellable material;

a slit cut longitudinally along the mantle inward from an outer surface of the mantle; and an arcuate groove formed on an outer surface of the mantle, corresponding to a displacement of the mantle caused by a cable inserted into an innermost end of the slit, wherein the arcuate groove is sized to counteract the displacement, wherein a size of the arcuate groove is determined by one or more of:

measuring a displacement of the mantle after insertion of a cable into the slit; and calculating the size based on a diameter of the cable to be inserted, a width of the slit, and a compressibility of the mantle.

* * * * *

UNITED STATES PATENT AND TRADEMARK OFFICE

CERTIFICATE OF CORRECTION

PATENT NO. : 9,212,533 B2
APPLICATION NO. : 14/212262
DATED : December 15, 2015
INVENTOR(S) : Jeffrey J. Lembcke It is certified that error appears in the above-identified patent and that said Letters Patent is hereby corrected as shown below:

Item (73) on the title page, the Assignee should be changed from "Weatherford/Lamb, Inc." to -- Weatherford Technology Holdings, LLC --.

Signed and Sealed this
Tenth Day of May, 2016

Michelle K. Lee

Michelle K. Lee
*Director of the United States Patent and Trademark Office*